US009162865B2

(12) United States Patent
Falcone

(10) Patent No.: US 9,162,865 B2
(45) Date of Patent: Oct. 20, 2015

(54) SELF CONTAINED BIO FUEL TRANS LOAD WITH HEATING APPARATUS FOR RAIL CARE OFFLOADING AND DISTRIBUTION

(71) Applicant: Dominic Michael Falcone, Yonkers, NY (US)

(72) Inventor: Dominic Michael Falcone, Yonkers, NY (US)

( * ) Notice: Subject to any disclaimer, the term of this patent is extended or adjusted under 35 U.S.C. 154(b) by 470 days.

(21) Appl. No.: 13/783,162

(22) Filed: Mar. 1, 2013

(65) Prior Publication Data

US 2014/0053948 A1 Feb. 27, 2014

Related U.S. Application Data

(60) Provisional application No. 61/693,234, filed on Aug. 24, 2012.

(51) Int. Cl.

| | |
|---|---|
| ***B67D 7/04*** | (2010.01) |
| ***B67D 7/82*** | (2010.01) |
| ***B67D 9/00*** | (2010.01) |
| ***F17C 5/00*** | (2006.01) |

(52) U.S. Cl.

CPC ..... *B67D 7/0498* (2013.01); *B67D 7/04* (2013.01); *B67D 7/82* (2013.01); *B67D 9/00* (2013.01); *F17C 5/007* (2013.01); *Y10T 137/85986* (2015.04)

(58) Field of Classification Search

CPC ..... B67D 7/04; B67D 7/0498; B67D 7/82; B67D 9/00

USPC ..... 141/82, 91, 98, 231, 285; 137/899, 137/234.6, 565.11; 280/830, 838–839; 122/DIG. 10; 414/809; 222/146.2, 222/146.4

See application file for complete search history.

(56) References Cited

U.S. PATENT DOCUMENTS

| | | | | |
|---|---|---|---|---|
| 2,410,900 | A * | 11/1946 | Radbill | 122/504.1 |
| 4,422,485 | A * | 12/1983 | O'Shea et al. | 141/98 |
| 5,468,117 | A * | 11/1995 | Lobko et al. | 414/809 |
| 5,609,193 | A * | 3/1997 | Steckler | 141/231 |
| 6,176,279 | B1 * | 1/2001 | Dahlin et al. | 141/231 |
| 2014/0352830 | A1 * | 12/2014 | Kenan et al. | 137/899 |

* cited by examiner

*Primary Examiner* — Timothy L Maust
*Assistant Examiner* — Timothy P Kelly

(57) ABSTRACT

A self-contained bio fuel trans load has a heating apparatus to allow different feed stock bio fuels to be trans loaded from a rail car to a vehicle or storage container. Several mechanical apparatus are incorporated into a single, self-contained unit which allows a safe and metered trans load of bio fuels from one point to another for the growing alternative energy market. The heating apparatus allows the bio fuel to be heated if necessary due to feed stock and pour point. The self-contained unit allows for distribution and metering of the bio fuel onto a vehicle for resale. The self-contained unit can be located at the most convenient site to achieve a minimum expenditure and liability.

14 Claims, 1 Drawing Sheet

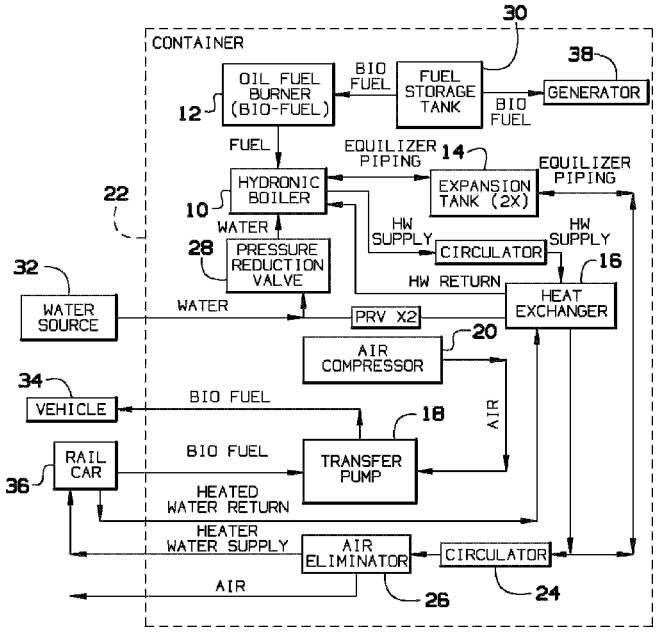

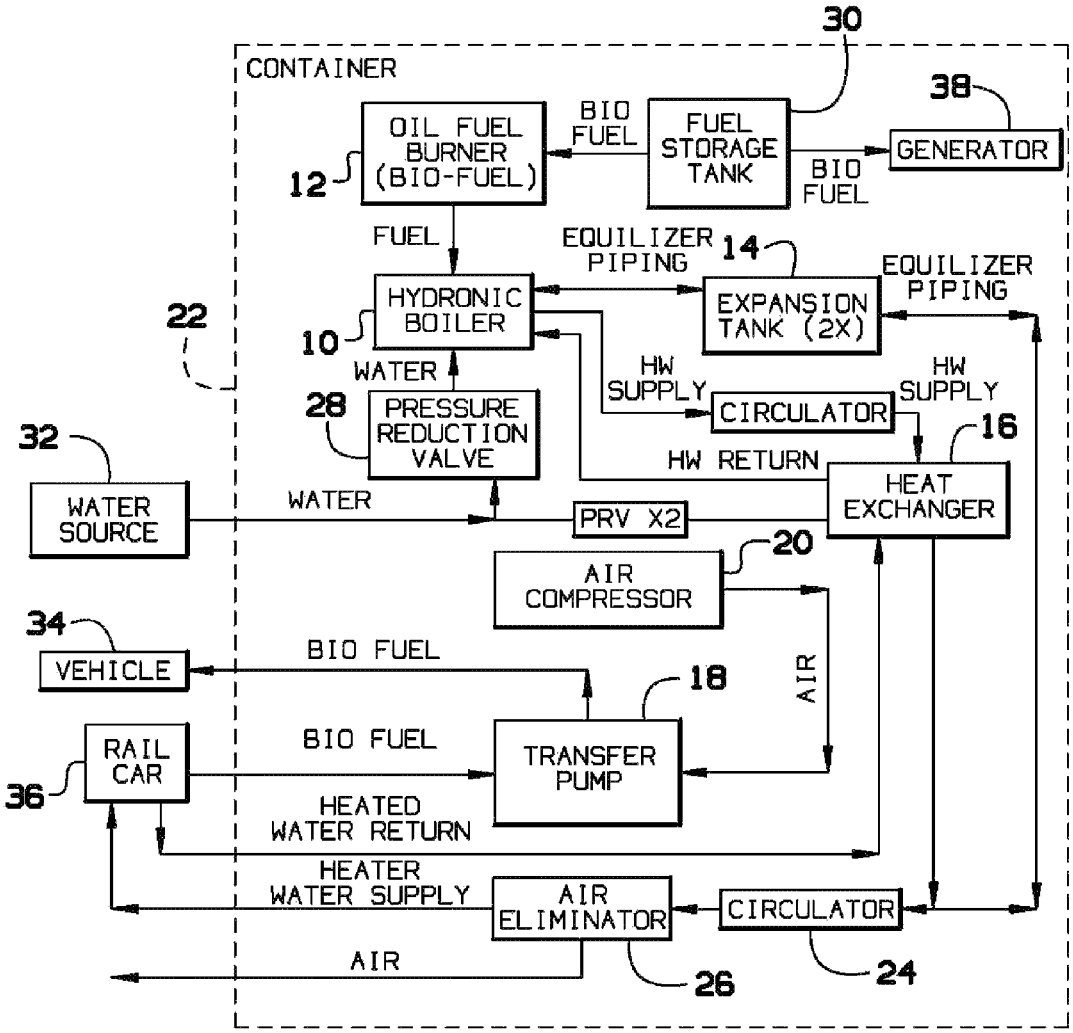
CONTAINER
30
38
OIL FUEL BURNER (BIO-FUEL)
BIO FUEL
FUEL STORAGE TANK
GENERATOR
BIO FUEL
12
FUEL
EQUILIZER PIPING
14
EQUILIZER PIPING
HYDRONIC BOILER
EXPANSION TANK (2X)
22
10
WATER
HW SUPPLY
HW SUPPLY
28
PRESSURE REDUCTION VALVE
CIRCULATOR
16
32
HW RETURN
HEAT EXCHANGER
WATER SOURCE
WATER
PRV X2
20
AIR COMPRESSOR
34
VEHICLE
BIO FUEL
18
AIR
RAIL CAR
BIO FUEL
TRANSFER PUMP
36
HEATED WATER RETURN
HEATER WATER SUPPLY
AIR ELIMINATOR
CIRCULATOR
AIR
26
24

SELF CONTAINED BIO FUEL TRANS LOAD WITH HEATING APPARATUS FOR RAIL CARE OFFLOADING AND DISTRIBUTION

CROSS-REFERENCE TO RELATED APPLICATION

This application claims the benefit of priority of U.S. provisional application No. 61/693,234, filed Aug. 24, 2012, the contents of which are herein incorporated by reference.

BACKGROUND OF THE INVENTION

The present invention relates to bio fuel trans load and, more particularly, to a self-contained bio fuel trans load with heating apparatus for rail car offloading and distribution.

Trans loading is the process of transferring a shipment from one mode of transportation to another. Biofuels are being used more and more and there is an increased demand for its distribution. Rail cars are often used for shipment of biofuels. These materials need to be offloaded from the rail cars into other modes of distribution locally. Regulating the temperature of the product being offloaded can be important, especially with materials such as biofuels.

Currently, there exist methods and devices for trans loading a product from a rail car and separate methods and devices for heating a rail car. However, there currently are no methods or devices for both trans loading with a heating apparatus for rail car offloading and distribution.

As can be seen, there is a need for a method and apparatus for bio fuel trans load with a heating apparatus for rail car offloading and distribution.

SUMMARY OF THE INVENTION

In one aspect of the present invention, a self-contained trans load device comprises a fuel storage tank; a hydronic boiler heating a first fluid via burning of fuel from the fuel storage tank; a circulator for circulating a second fluid, warmed by the first fluid, through a first storage vessel holding a commodity to be transferred; and a transfer pump and metering device for transferring the commodity from the first storage vessel to a second storage vessel.

In another aspect of the present invention, a self-contained trans load device comprises a fuel storage tank; a hydronic boiler heating a first fluid via burning of fuel from the fuel storage tank; a heat exchanger receiving the first fluid; a circulator for circulating a second fluid through the heat exchanger to be warmed by the first fluid, the circulator further circulating the second fluid through a rail car holding a commodity to be transferred; a transfer pump and metering device for transferring the commodity from the first storage vessel to a second storage vessel; and an air compressor for clearing piping between the self-contained trans load device and the first storage vessel and the second storage vessel.

These and other features, aspects and advantages of the present invention will become better understood with reference to the following drawings, description and claims.

BRIEF DESCRIPTION OF THE DRAWINGS

The Figure is a schematic representation of a self-contained bio fuel trans load device according to an exemplary embodiment of the present invention.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a self-contained bio fuel trans load with heating apparatus to allow different feed stock bio fuels to be trans loaded from a rail car to a vehicle or storage container. Several mechanical apparatus are incorporated into a single, self-contained unit which allows a safe and metered trans load of bio fuels from one point to another for the growing alternative energy market. The heating apparatus allows the bio fuel to be heated if necessary due to feed stock and pour point. A hydronic boiler can be used to heat the rail car through heat exchangers, allowing the bio fuel to liquefy for a safe distribution by connecting hoses. The self-contained device allows for distribution and metering of the bio fuel onto a vehicle for resale. The self-contained device can be located at the most convenient site to achieve a minimum expenditure and liability.

Referring now to the Figure, a fuel storage tank 30 can feed an oil fuel burner 12 which, in conjunction with a hydronic boiler 10, can heat a hydronic heat exchanger 16 by using a circulator, such as a high head and volume circulator to circulate a first fluid, such as water, from a source 32, typically an external source. A circulator 24 is also used to circulate a second fluid, such as water, from the hydronic heat exchanger 16 (to exchange heat with the first fluid) to the rail car 36 and back. A hydronic air elimination device 26 can be used for both processes.

An expansion tank 14, pressure relief valve and pressure reducing valve 28 can be used in conjunction for safe operation of equipment. An electric powered trans load pump with metering device 18 can be used to trans load product (such as bio fuel) from a rail car 36 to a vehicle 34 with high volume air compression from an air compressor 20 to clear all product out of the trans load piping.

By utilizing a heating apparatus with a metering device in a safe and enclosed unit 22, this will make it possible to create a demanded commodity readily accessible from production to end user.

The system of the present invention can be made in a self-contained portable unit 22 with the hydronic boiler 10 installed therein, the hydronic boiler 10 can be sized for demand of each rail car coil. Circulation gallons per minute can be sized for recovery to allow a continuous off load of bio fuel from rail car 36 to the vehicle 34, such as a truck or a container. The trans load pump with the metering device 18 can be installed in the same self-contained portable unit 22. The pump 18 allows the safe and controlled distribution of the bio fuel. The compressor 20 can be sized to provide an adequate volume to completely dispense of any residual product from the piping of the trans load.

A generator 38 can be provided within the container to provide electric power to various component, such as the pump 18, and the like. The generator 38 can be configured to operate on various fuels. In some embodiments, the generator 38 can operate on bio fuel, similar to that used in the oil fuel burner 12. Bio fuel is known to deliver a fuel output about three times the cost needed to make the bio fuel, thus contributing to the energy efficiency of the system.

While the above refers to trans load of bio fuel, the system of the present invention can be used for all commodities that require heating to distribute from a rail car to a transporting vehicle. The system of the present invention allows any product that needs to be heated to a consistency to be moved from one container to another, to be safely transferred and metered at the same time in a controlled environment.

It should be understood, of course, that the foregoing relates to exemplary embodiments of the invention and that modifications may be made without departing from the spirit and scope of the invention as set forth in the following claims.

What is claimed is:

1. A self-contained trans load device comprising:

a fuel storage tank;

a hydronic boiler heating a first fluid via burning of fuel from the fuel storage tank;

a circulator for circulating a second fluid, warmed by the first fluid, through a first storage vessel holding a commodity to be transferred; and a transfer pump and metering device for transferring the commodity from the first storage vessel to a second storage vessel.

2. The self-contained trans load device of claim 1, further comprising a heat exchanger for exchanging heat between the first fluid and the second fluid.

3. The self-contained trans load device of claim 1, wherein the first fluid and the second fluid include water.

4. The self-contained trans load device of claim 1, further comprising an air compressor for clearing piping between the self-contained trans load device and the first storage vessel and the second storage vessel.

5. The self-contained trans load device of claim 1, wherein the first storage vessel is a rail car.

6. The self-contained trans load device of claim 1, wherein the second storage vessel is a vehicle.

7. The self-contained trans load device of claim 1, further comprising an air eliminator for removing air from the second fluid.

8. The self-contained trans load device of claim 1, further comprising a pressure reduction valve and at least one expansion tank fluidly connected with the hydronic boiler.

9. The self-contained trans load device of claim 1, wherein the commodity is a bio fuel.

10. The self-contained trans load device of claim 1, further comprising a generator burning bio fuel to generate electricity.

11. A self-contained trans load device comprising:

a fuel storage tank for storing a bio fuel;

a hydronic boiler heating a first fluid via burning of fuel from the fuel storage tank;

a generator generating electricity from burning of fuel from the fuel storage tank;

a heat exchanger receiving the first fluid;

a circulator for circulating a second fluid through the heat exchanger to be warmed by the first fluid, the circulator further circulating the second fluid through a rail car holding a commodity to be transferred;

a transfer pump and metering device for transferring the commodity from the first storage vessel to a second storage vessel; and an air compressor for clearing piping between the self-contained trans load device and the first storage vessel and the second storage vessel.

12. The self-contained trans load device of claim 11, further comprising an air eliminator for removing air from the second fluid.

13. The self-contained trans load device of claim 11, further comprising a pressure reduction valve and at least one expansion tank fluidly connected with the hydronic boiler.

14. The self-contained trans load device of claim 11, wherein the second storage vessel is a vehicle.

* * * * *